US007766056B2

(12) United States Patent
Rapparini

(10) Patent No.: US 7,766,056 B2
(45) Date of Patent: Aug. 3, 2010

(54) COMBINED DEVICE TO FEED AND COMPACT PRESET DOSES OF GROUND COFFEE OR OTHER SIMILAR SUBSTANCES

(75) Inventor: Gino Rapparini, Bologna (IT)

(73) Assignee: Aroma System SRL, Bologna (IT)

( * ) Notice: Subject to any disclaimer, the term of this patent is extended or adjusted under 35 U.S.C. 154(b) by 753 days.

(21) Appl. No.: 11/569,852

(22) PCT Filed: May 30, 2005

(86) PCT No.: PCT/IB2005/001511

§ 371 (c)(1),
(2), (4) Date: Nov. 30, 2006

(87) PCT Pub. No.: WO2005/120957

PCT Pub. Date: Dec. 22, 2005

(65) Prior Publication Data

US 2008/0283144 A1 Nov. 20, 2008

(30) Foreign Application Priority Data

Jun. 8, 2004 (IT) ..... BO2004A0363

(51) Int. Cl.
*B65B 1/20* (2006.01)

(52) U.S. Cl. ..... 141/80; 141/129; 99/295

(58) Field of Classification Search ..... 99/295; 53/528; 141/12, 129, 163, 71, 73, 80
See application file for complete search history.

(56) References Cited

U.S. PATENT DOCUMENTS

| | | | | |
|---|---|---|---|---|
| 280,478 | A * | 7/1883 | Hunter et al. | 141/12 |
| 2,603,927 | A | 7/1952 | Grey | |
| 4,404,787 | A | 9/1983 | Hazelwood | |
| 4,747,250 | A | 5/1988 | Rossi | |
| 5,637,335 | A | 6/1997 | Fond et al. | |

FOREIGN PATENT DOCUMENTS

| | | |
|---|---|---|
| EP | 0 300 519 | 1/1989 |
| EP | 0 943 544 | 9/1999 |
| WO | 99 47423 | 9/1999 |

* cited by examiner

*Primary Examiner*—Gregory L Huson
*Assistant Examiner*—Jason K Niesz
(74) *Attorney, Agent, or Firm*—Oblon, Spivak, McClelland, Maier & Neustadt, L.L.P.

(57) ABSTRACT

A combined device to feed and compact preset doses of ground coffee or other similar substances includes the combination of two operating devices, the first operating device including a measuring screw in an upright position, the second operating device including a compacting piston in an oblique position that is arranged perpendicular to concavities which are geometrically congruent with the morphology of the doses to be compacted inside dies located on a polygonal conveyer.

8 Claims, 10 Drawing Sheets

COMBINED DEVICE TO FEED AND COMPACT PRESET DOSES OF GROUND COFFEE OR OTHER SIMILAR SUBSTANCES

FIELD OF THE ART

The present invention concerns the technology of the packaging machines for pads made out of filtering paper. International Classification B65b.

STATE OF THE ART

Filtering paper pads to package doses of ground products with heterogeneous granularity are well known. All the known machines have specific problems as far as the control of the pad's shape and of the presence of product's resides at the edges of the pad, and also for the regulation of the degree of compactness of the resulting pads. The problem to be solved is in fact to obtain flawless pads with respect to the shape and to presence the product's residues at the edges of the pad.

SUMMARY OF THE INVENTION

The combined device introduced by this invention solves the problems mentioned above, and it is also affordable in its practical realization. In particular, the combined device features a monobloc structure resulting from the combination of the measuring and the compacting equipment. Such solution ensures the highest reliability during the industrial application, even under high production demands.

DETAILED DESCRIPTION

Figure 1:
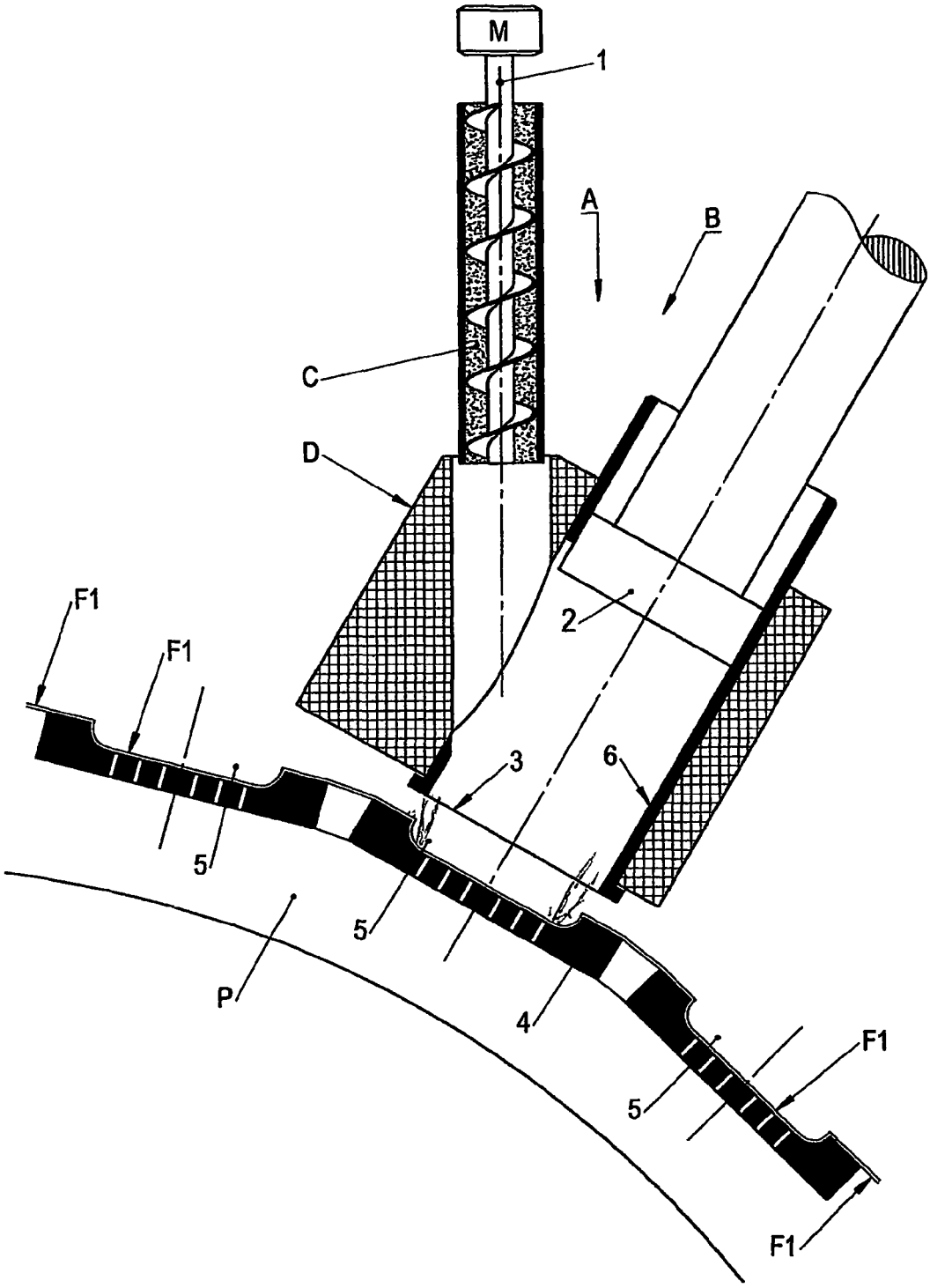
FIG. 1 is a sectional view of the rest phase of the combined device.
Figure 2:
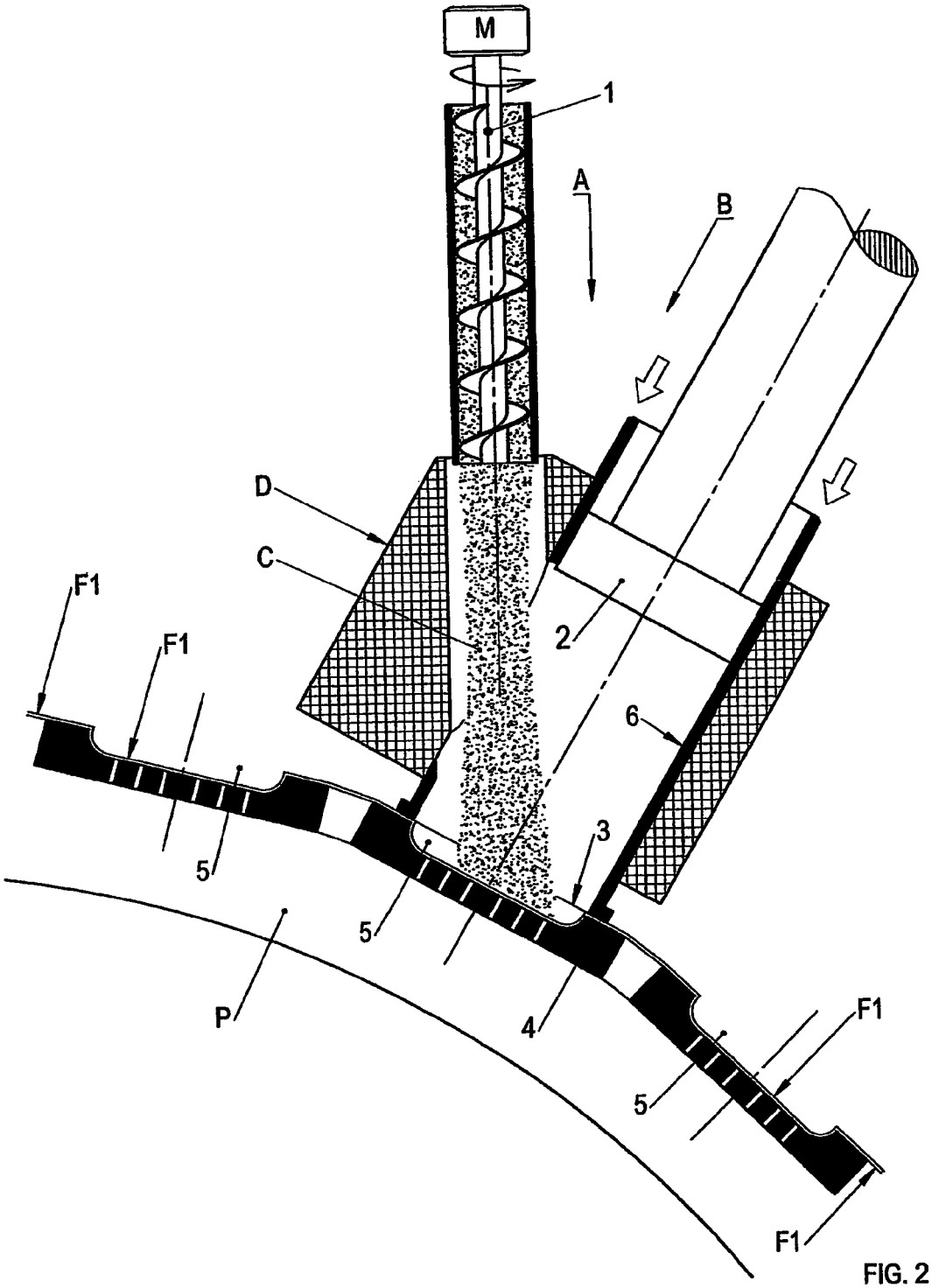
FIG. 2 is a sectional view of the beginning of a phase of the feeding operation of the granular product.
Figure 3:
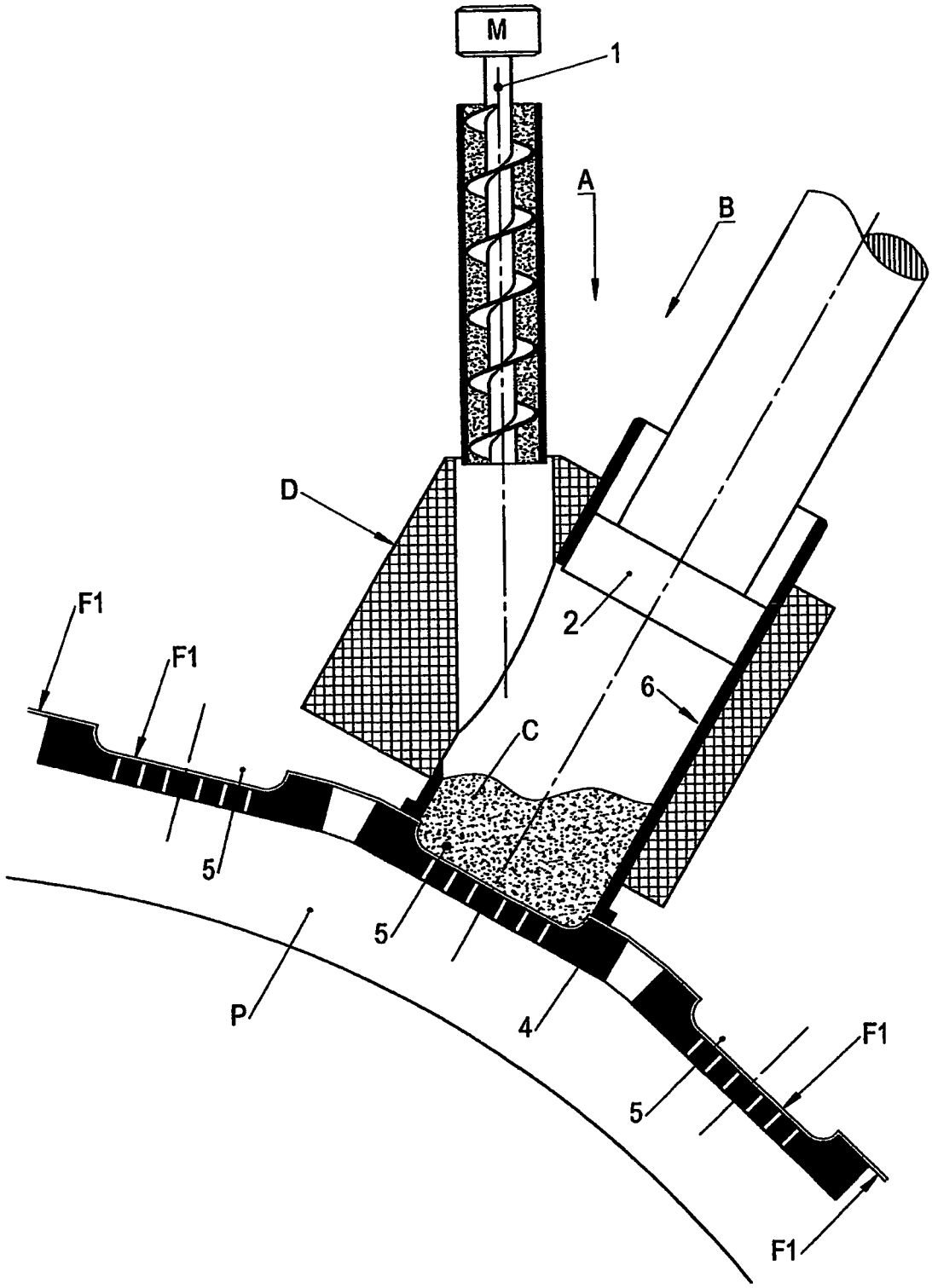
FIG. 3 is a sectional view of the completion of the gravity-based feeding process.
Figure 4:
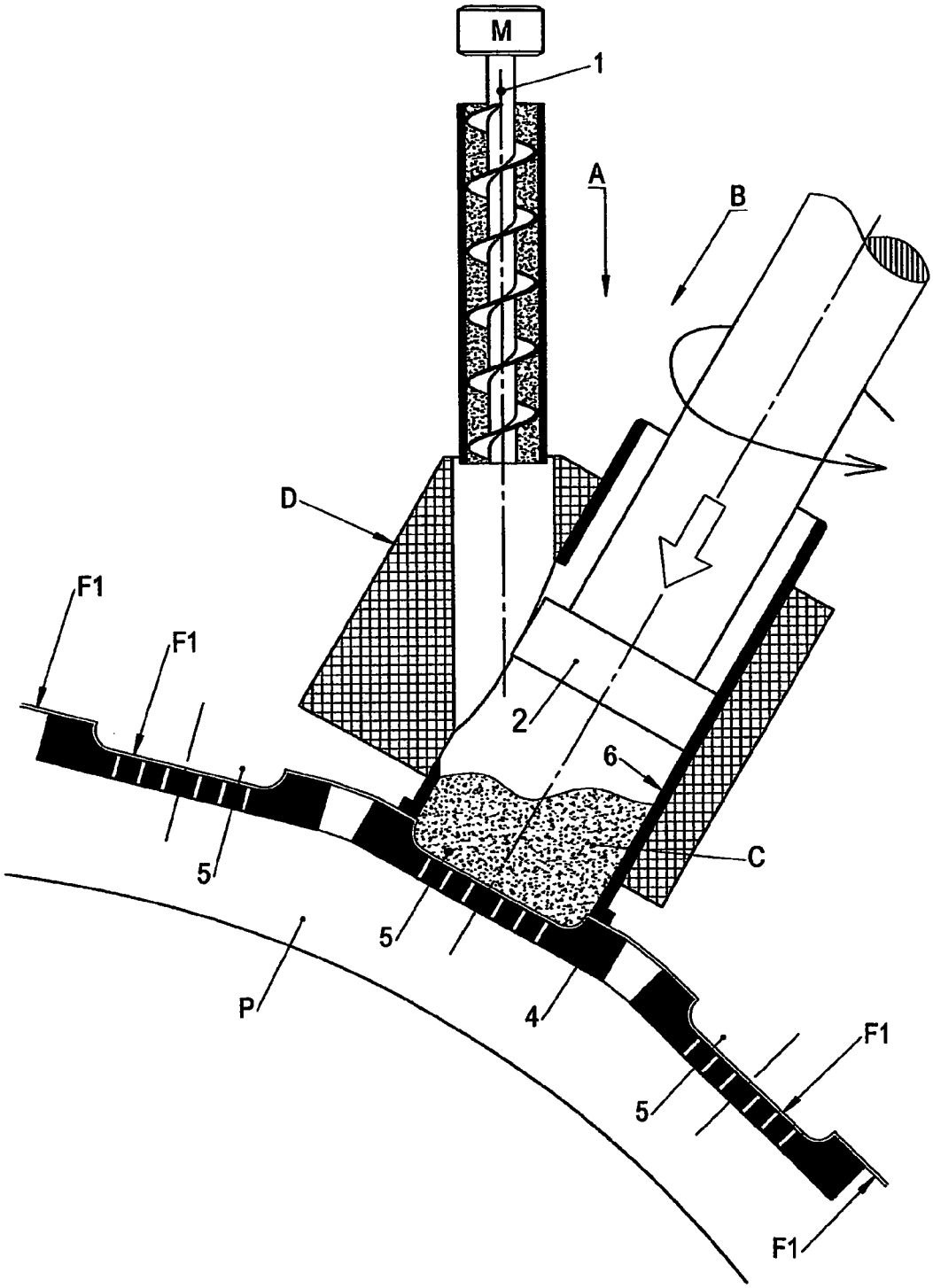
FIG. 4 is a sectional view of the intervention of the sliding and turning compacting piston inside the moving liner.
Figure 5:
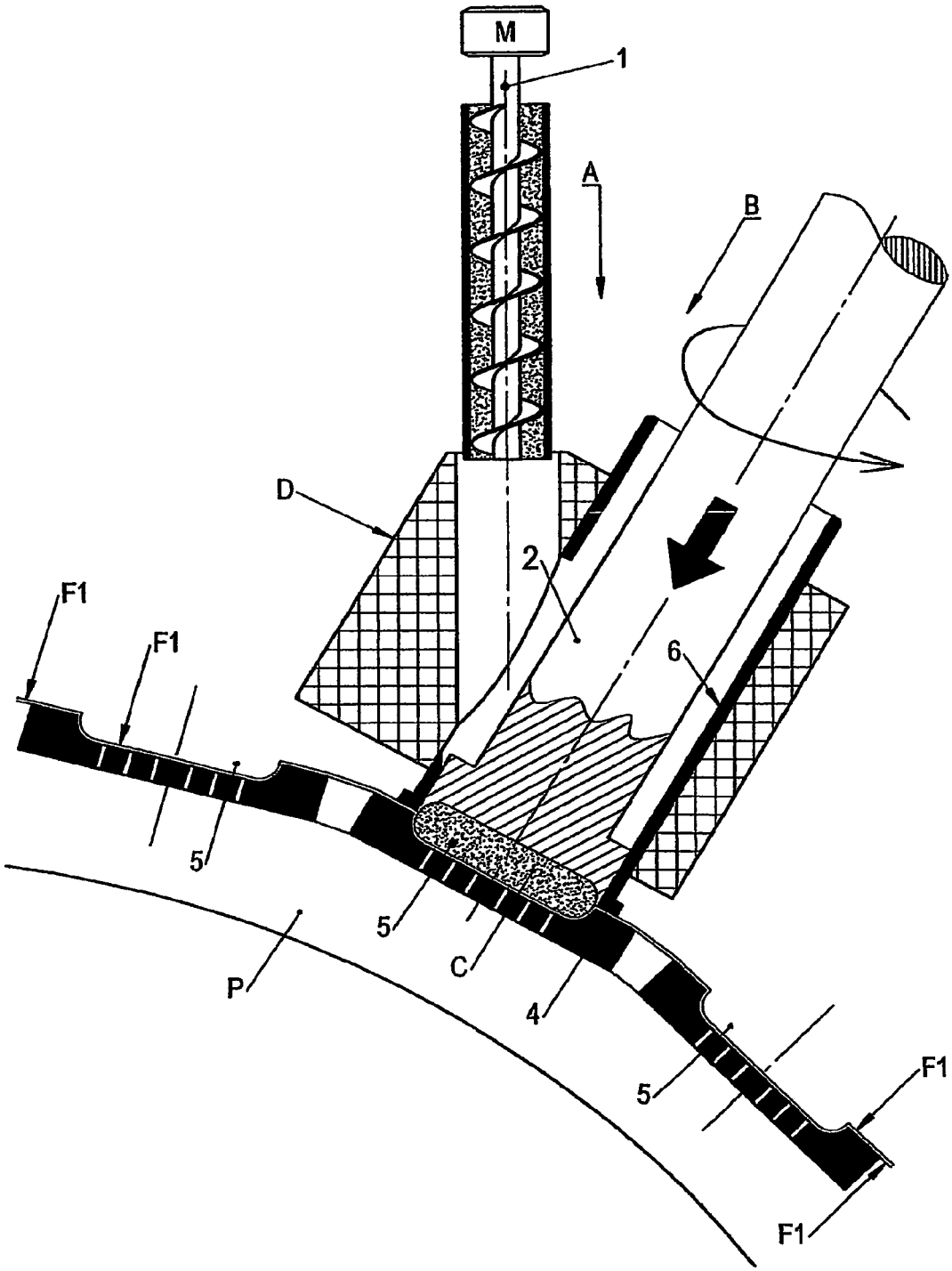
FIG. 5 is a sectional view showing the compacting of the product into a symmetric pad.
Figure 5B:
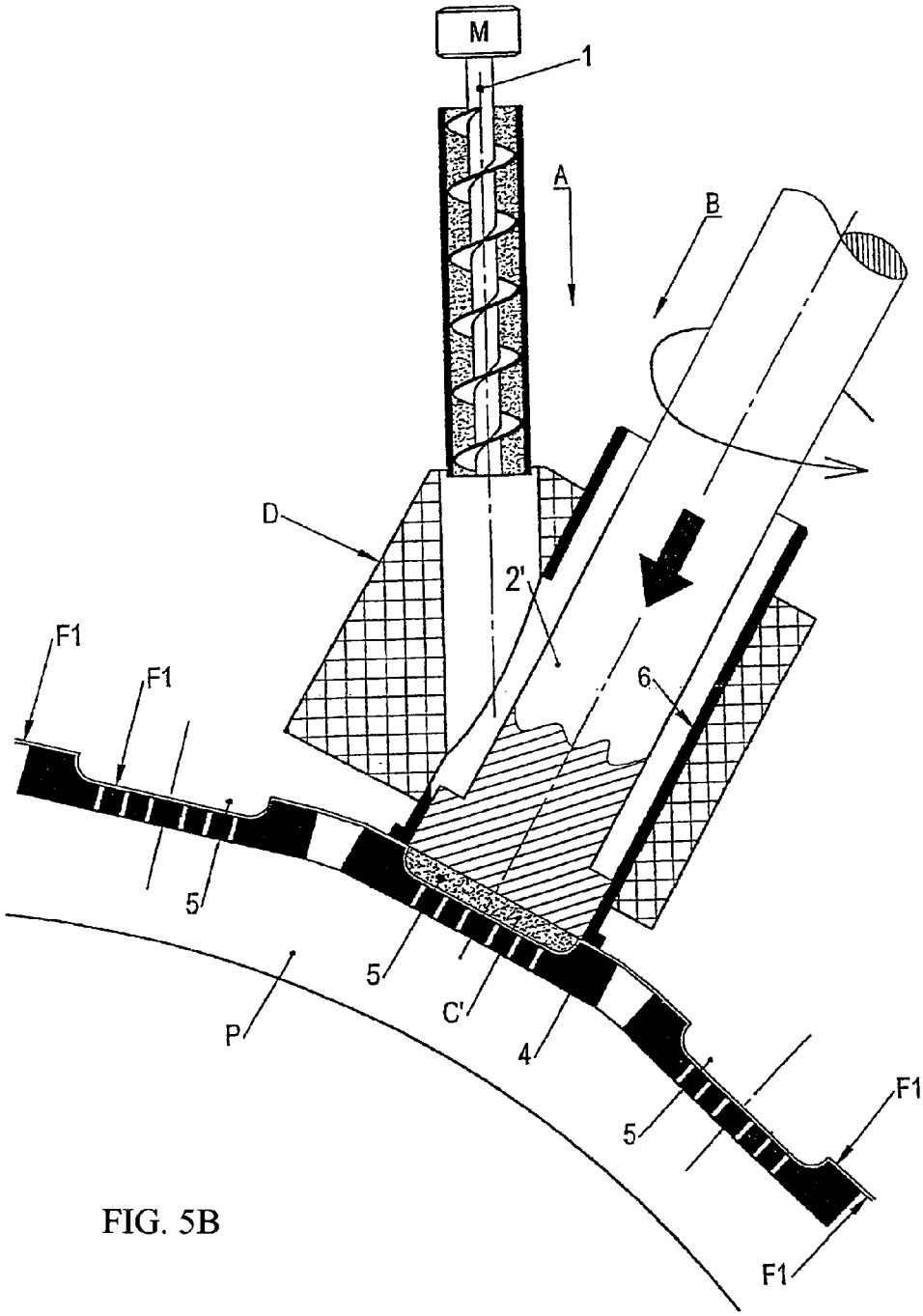
FIG. 5*b* is a sectional view showing the compacting phase of the product into an asymmetric compacted pad.
Figure 6:
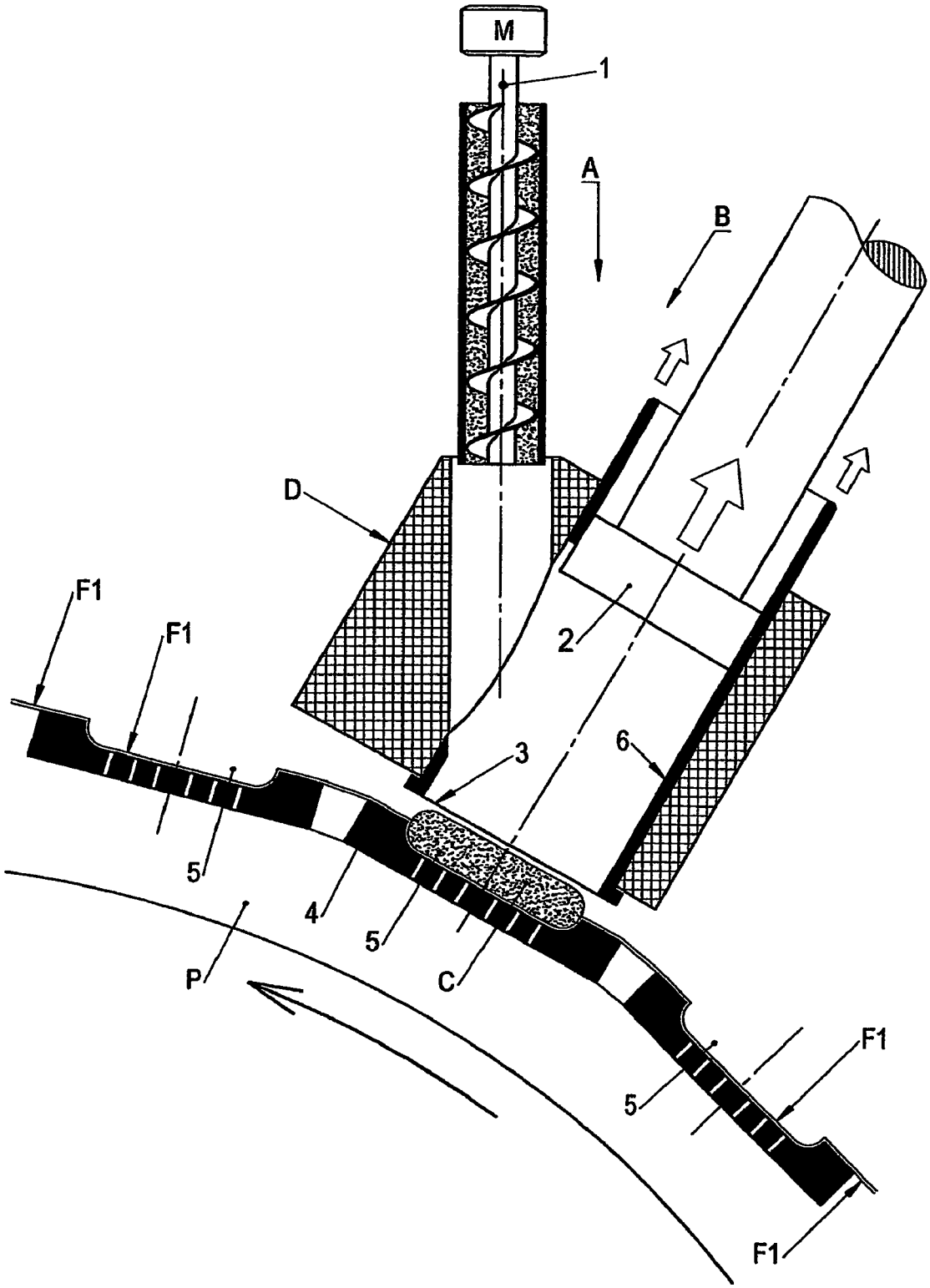
FIGS. 6 and 6*b* are sectional views showing the device immediately after the compacting.
Figure 6B:
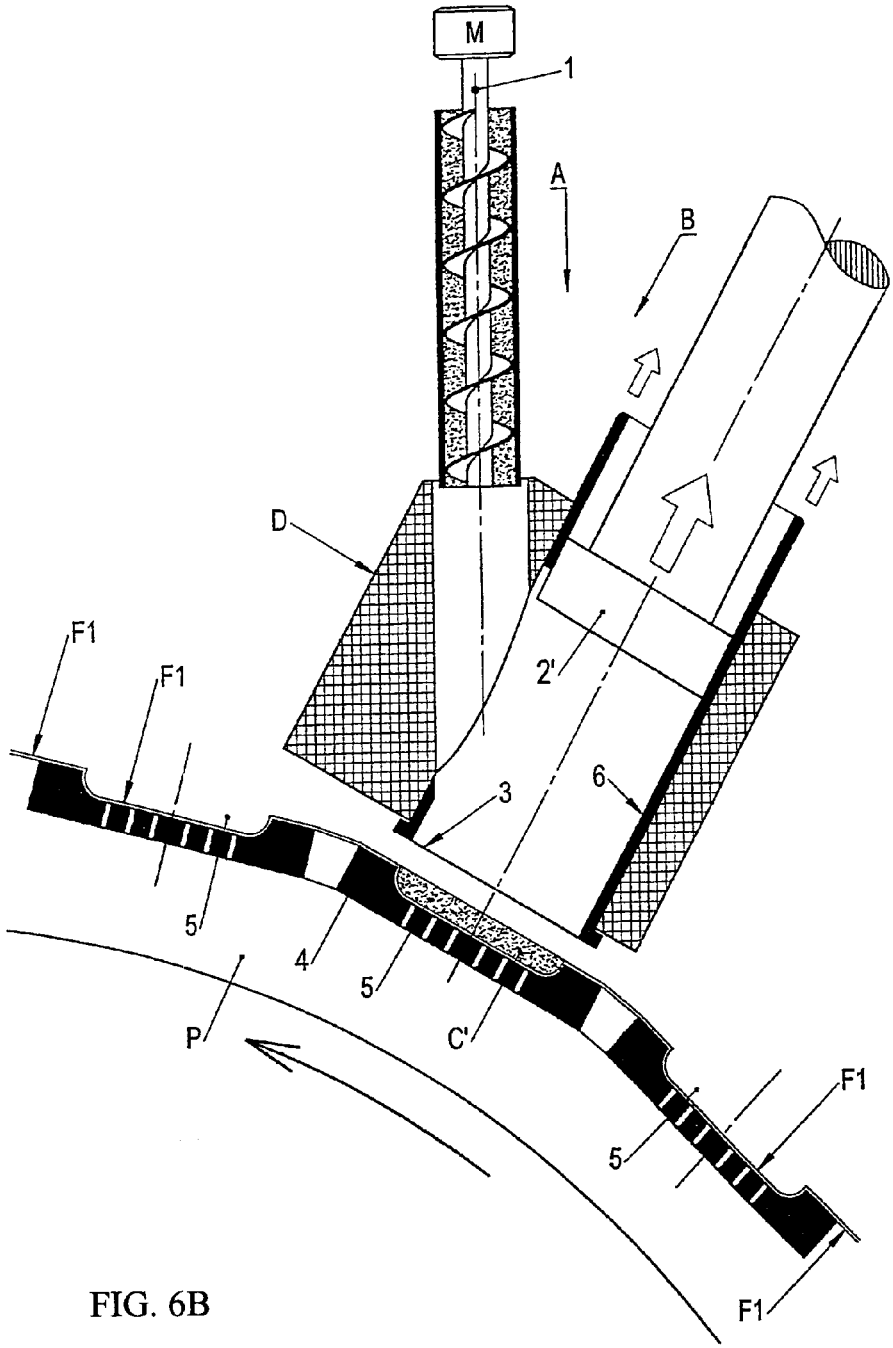
Figure 7:
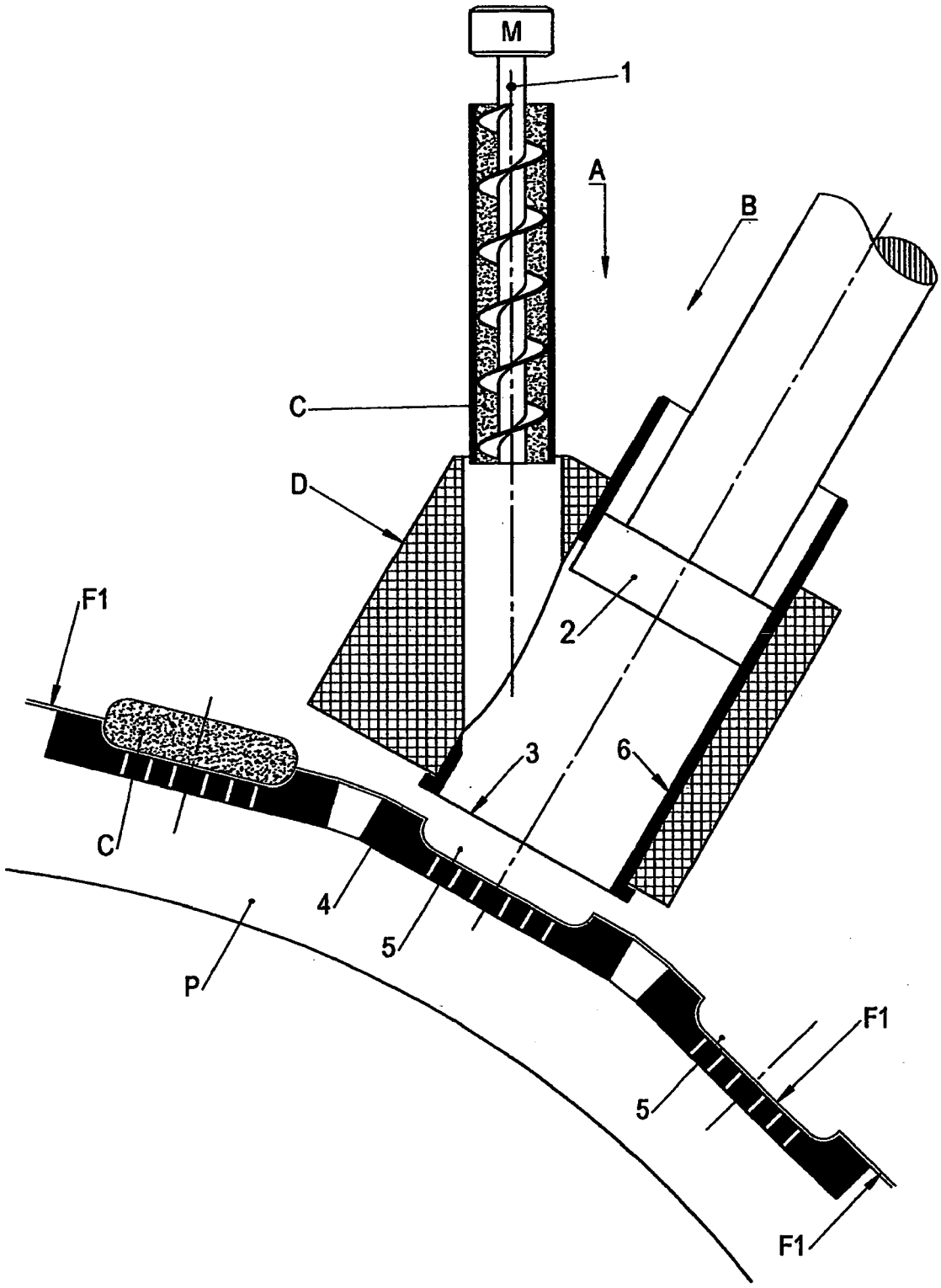
FIGS. 7 and 7*b* are sectional views showing the completion of the compacting operation.
Figure 7B:
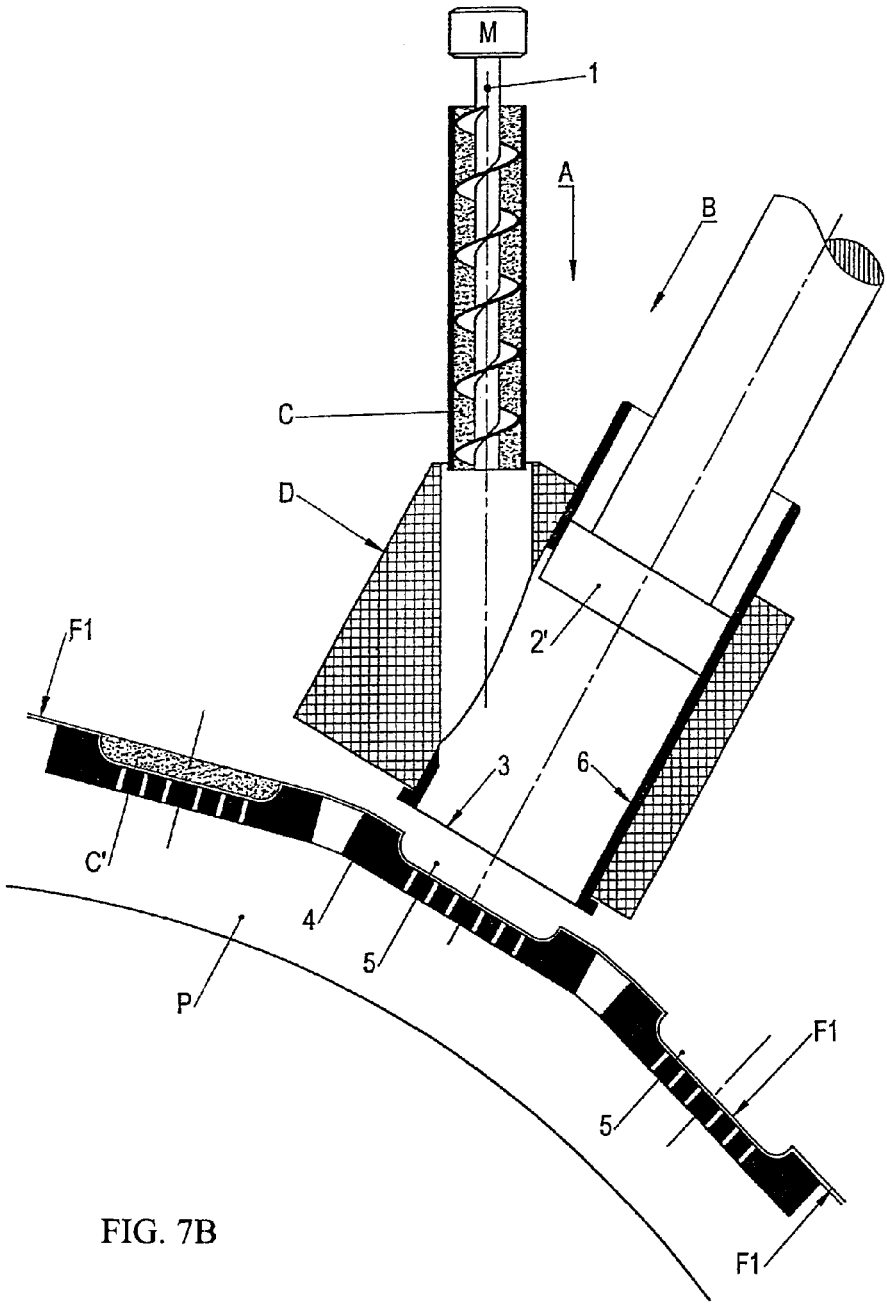

1 is a measuring screw for the measuring and the regulation of the quantity of product to be introduced and compacted into each pad.

2 indicates the head of a rotating and translating compacting piston to compact symmetrical pads.

2' indicates the flat head of a piston to compact asymmetrical pads.

3 indicates the lower edge of the sliding liner (6).

4 indicates an interchangeable die provided with concavities geometrically congruent to the configurations of the pads.

5 indicates the concavities matching with the format of the pads.

6 indicates the moving liner within which the rotating and translating compacting piston slides.

A indicates the upright measuring equipment.

B indicates the oblique compacting equipment.

C indicates the product packaged into symmetrically shaped compact pads.

C' indicates the product packaged into asymmetrically shaped compact pads.

D indicates the structure of the combined devices consisting of the equipments (A, B).

F1 indicates the film of filtering paper.

M indicates the time-switched engine.

The clearness of the figures highlights the simplicity of the device that is the object of the present invention, and highlights the compactness of the monobloc structure (D) in which are combined both the operating devices (A, B) that act in conjunction for the measuring and the compacting of the preset doses of product in symmetric and asymmetric pads of filtering paper.

The invention of course allows for several variations of practical realization both for overall dimensioning and structural proportioning, and also for the technological choices of the materials employed during the production process.

It is evident that the diameter, the depth and the degree of compactness of the pads will adjust the production demands.

The inventive core of the present invention consists therefore in the combination within a single monobloc structure (D) of two operating equipments (A, B) that act in conjunction to package compacted filtering pads, and upon its disclosure any average technician will be able to realize it without any inventive effort.

The invention claimed is:

1. A packaging machine for filter-paper pads comprising:

a combined device to feed and compact preset doses of ground coffee or other similar substances, the combined device including:

two operating devices, a first operating device including a measuring screw in a vertical upright position, and a second operating device including a compacting piston in an oblique position relative to the measuring screw, wherein the compacting piston is oriented perpendicular to concavities which geometrically correspond to the filter-paper pads containing a preset dose to be compacted and which are located in dies on a polygonal conveyer, and wherein the second operating device rotates the compacting piston about a longitudinal axis thereof while the preset dose to be compacted is compressed by the compacting piston.

2. The packaging machine of claim 1, wherein the compacting piston rotates about and translates along the longitudinal axis within a liner which is movable along the longitudinal axis relative to the compacting piston.

3. The packaging machine of claim 2, wherein a lower edge of the movable liner is orientated perpendicular to the longitudinal axis of the piston and parallel to the concavities of the dies.

4. The packaging machine of claim 1, wherein a film of filter paper is placed on one of the polygonal conveyor, the polygonal conveyer being arranged beneath the combined device.

5. The packaging machine of claim 1, wherein the combined device includes a monobloc structure in which the first and the second operating devices are combined.

6. The packaging machine of claim 2, wherein the movable liner distributes the preset dose into one of the concavities such that no portion of the preset dose spills outside the one of the concavities.

7. The packaging machine of claim 1, wherein the measuring screw measures and regulates a quantity of the ground coffee to be compressed by the compacting piston.

8. A packaging machine for filter-paper pads comprising:

a combined device to feed and compact preset doses of ground coffee or other similar substances, the combined device including:

two operating devices, a first operating device including a measuring screw in a vertical upright position, and a second operating device including a compacting piston in an oblique position relative to the measuring screw, wherein the compacting piston is oriented perpendicular to concavities which geometrically correspond to the filter-paper pads containing a preset dose to be compacted and which are located in dies on a polygonal conveyer, wherein the second operating device rotates the compacting piston about a longitudinal axis thereof while the preset dose to be compacted is compressed by the compacting piston, and wherein the movable liner distributes the preset dose into one of the concavities such that no portion of the preset dose spills outside the one of the concavities.

* * * * *